United States Patent [19]

Williams

[11] Patent Number: 4,568,324

[45] Date of Patent: Feb. 4, 1986

[54] ROTOR SHAFT HAVING DAMPER MEMBER MOUNTED THEREON

[75] Inventor: John F. Williams, New Canaan, Conn.

[73] Assignee: E. I. Du Pont de Nemours and Company, Wilmington, Del.

[21] Appl. No.: 669,853

[22] Filed: Nov. 9, 1984

[51] Int. Cl.[4] ..... B04B 9/14

[52] U.S. Cl. ..... 494/82; 494/83; 494/84

[58] Field of Search ..... 494/82, 83, 84, 85; 68/23.1, 23.2, 23.3; 366/232

[56] References Cited

U.S. PATENT DOCUMENTS

| | | | |
|---|---|---|---|
| 3,322,338 | 5/1967 | Stallman | 494/82 |
| 4,226,359 | 10/1980 | Jacobson | 494/83 |
| 4,322,030 | 3/1982 | Jacobson | 494/83 |
| 4,412,831 | 11/1983 | Avery | 494/82 |

*Primary Examiner*—Robert W. Jenkins

[57] ABSTRACT

The drive shaft assembly for a centrifuge includes a resilient damper member mounted between a flexible shaft element and a bearing shaft element for rotation therewith. Vibrations imposed on the flexible shaft element by a centrifuge rotor are damped by the resilient damper member.

6 Claims, 4 Drawing Figures

94A
94B
96
94S
74
76
74H 20
90
86
88
76
94B
94A
94S
96
92
74
70B
68D
74H
68C
28
28
82
74
70A
84
68A
22
78
80
82
68B

ROTOR SHAFT HAVING DAMPER MEMBER MOUNTED THEREON

FIELD OF THE INVENTION

This invention relates to centrifuges and, in particular, to a centrifuge in which the rotor shaft has a damper member mounted thereon.

DESCRIPTION OF THE PRIOR ART

The typical oil turbine drive ultracentrifuge such as that manufactured and sold by E. I. du Pont de Nemours and Company includes a rotor member mounted on the interior of an evacuated bowl for rotational movement with respect to a vertical axis. The rotor is mounted on a shaft member the upper end of which projects into the bowl and the lower end of which extends into a drive cartridge. Within the drive cartridge a source of motive energy, such as oil turbine, is operatively connected to the shaft so that motive energy is applied thereto and, through the shaft, to the rotor. The rotor shaft is flexible to accommodate vibrations generated by the rotation of the rotor about its axis. If unchecked such vibrations could conceivably cause the rotor to unseat from the end of the shaft projecting into the rotor bowl.

The damper element in the present centrifuge apparatus takes the form of a bearing which is nonrotationally mounted with respect to the drive cartridge such that a rotational interface is defined between the damper bearing and the flexible drive shaft. Accordingly, it is necessary to provide a lubricating fluid along the contacting interface between the rotating flexible shaft and the relatively nonrotating damper bearing. The definition of this frictional interface between the flexible shaft and the damper bearing increases the power required to maintain an ultracentrifuge rotor running at high speed.

Accordingly, it is believed advantageous to provide a drive system for a centrifuge rotor which eliminates the frictional interface between the flexible shaft and the damper bearing thereby providing a greatly reduced frictional load on the rotor and concomittantly reducing the power required to maintain the rotor at a given running speed.

SUMMARY OF THE INVENTION

In accordance with the present invention, a centrifuge includes a rotor rotatable within a chamber about an axis of rotation. A source of motive energy for the rotor is mounted in a housing cartridge beneath the chamber. The rotor is connected to the source of motive energy by a drive shaft assembly formed of a first, upper, flexible shaft element and a second, lower, bearing shaft element. The flexible shaft element has one end projecting into the chamber whereon the rotor may be mounted and a second end extending for a predetermined distance into the cartridge. The second bearing shaft element is connected at one end thereof to the source of motive energy. The second shaft element has a hollow recess extending over the portion of its length into which the second end of the first shaft element projects into a connected relationship. Thus the first shaft element is received within and surrounded over a predetermined portion of its length by a portion of the second shaft element. A damper arrangement is mounted to the flexible shaft for rotation therewith at a point intermediate the concentrically disposed first and second shaft elements. The damper arrangement includes a resilient damper member disposed between the flexible shaft element and the bearing shaft element to accommodate the flexure of the flexible shaft element in response to vibrations of the rotor. However, since the damper member is mounted for rotation with the flexible shaft element the frictional interface defined as in the prior art in eliminated.

BRIEF DESCRIPTION OF THE DRAWING

The invention will be more fully understood in the following detailed description thereof taken in connection with the accompanying drawings which form a part of this application and in which:

FIG. 2 is a elevational view entirely in section of a drive cartridge receivable in the drive housing of FIG. 1 while FIG. 2A is an enlarged view of a damper arrangement for the rotor drive shaft assembly in accordance with the present invention.

DETAILED DESCRIPTION OF THE INVENTION

Figure 1:
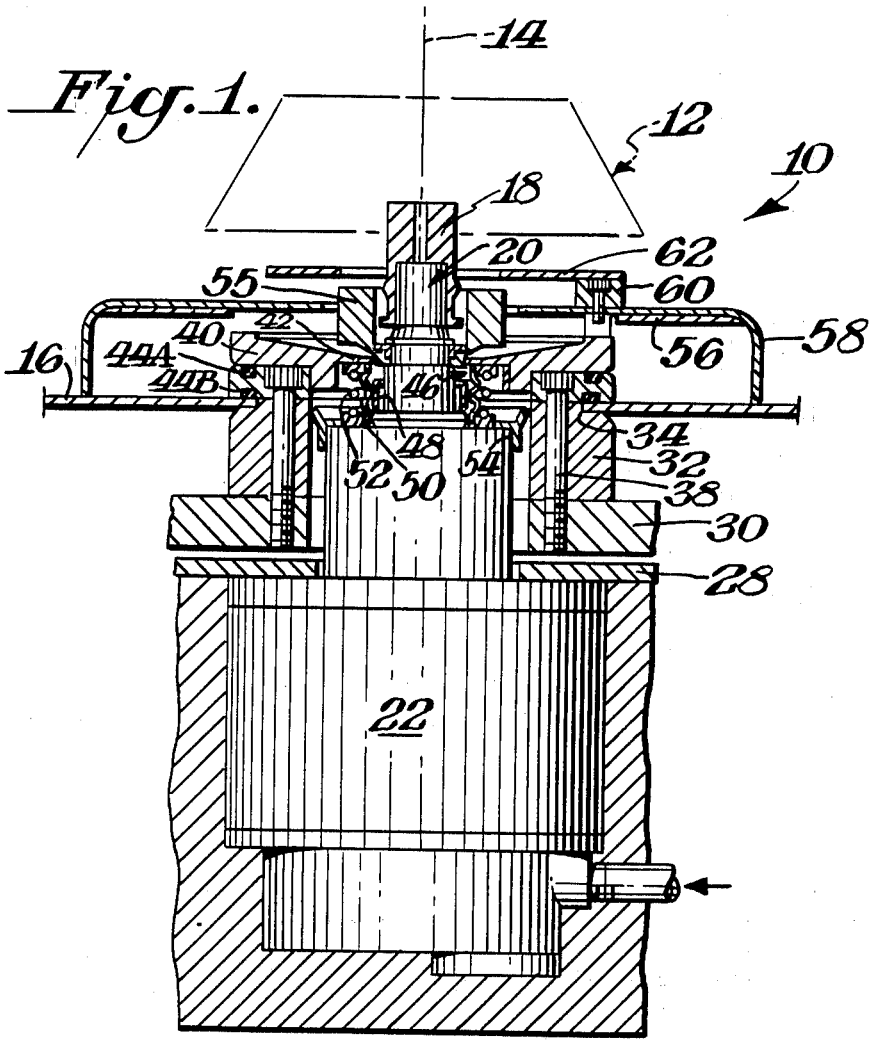
FIG. 1 is a side elevational view entirely in section of a centrifuge rotor drive housing adapted to accommodate a rotor drive shaft assembly in accordance with the present invention.

Throughout the following detailed description similar reference numerals refer to similar elements in all figures of the drawings.

With reference to FIG. 1 shown is a side elevational view in section of a portion of a centrifuge generally indicated by reference numeral 10 in which a rotor 12 may be mounted for rotation about an axis of rotation 14. The rotor is received in a bowl 16 which completely encloses the rotor 10. The interior of the bowl 16 defines a chamber which may be evacuated and cooled by the provision of an appropriate evacuation and cooling system.

The rotor 12 is received, as shown in FIG. 1, in a driven relationship on a drive adaptor 18. The adaptor 18 which projects upwardly into the chamber defined by the bowl 16 atop a drive shaft assembly generally indicated by the reference character 20. The shaft assembly 20 emanates from the upper end of a drive cartridge 22 described in connection with FIG. 2. The drive cartridge 22 is fixedly mounted beneath the bowl 16 on a mounting plate 28. The mounting plate 28 is in turn mounted by a shock mount (not shown) to a plate 30 that forms part of the superstructure of the centrifuge 10. An insulation piece 32 is received atop the plate 30. The insulation piece 32 is received within a central aperture 34 formed in the bottom surface of the bowl 16 such that a portion of the insulation piece 32 projects both above and below the lower boundary of the bowl 16. Suitable mounting bolts 38 secure the insulation piece 32 to the plate 30. A cap assembly 40 having an annular radially inwardly directed lip 42 thereon is received atop the upper portion of the insulation piece 32. Ring seals 44A, 44B are provided respectively between the interface between the upper portion of the insulating piece 32 and the cap 40 and the interface between the insulation piece 32 and the bowl 16 in order to prevent the entry of air into the bowl 16 when the same is evacuated during operation.

A vacuum seal 46 in the form of an flexible bellows 48 is disposed between the lower surface of the lip 42 of a cap 40 and a shoulder 50 provide on the upper end of the drive cartridge 22. A biasing spring 52 serves to press the upper and lower flanges of the bellows 40 into sealed engagement with the above defined surfaces to maintain the sealed integrity between the evacuated interior of the bowl 16 and the exterior thereof. A moisture seal 54 is provided on the upper portion of the drive housing to prevent the entry of condensate.

An upwardly projecting collar 55 is mounted to the drive cartridge 22. The collar 55 carries photoelectric and magnetic tachometer elements which respectively respond to the passage of suitable indicia on the underside of the rotor 12 and the periphery of the adaptor 20 to provide electrical signals representative of the rotational speed of the rotor. The electronic components 56 associated with the photoelectric and magnetic transducers are housed within a shielded volume defined on the interior of the bowl 16 by heat shield 58. Mounted atop the heat shield 58 on a bracket 60 is a temperature sensing circuit board 62 operative to provide an indication of the temperature of the rotor 12.

Figures 2, 2A:
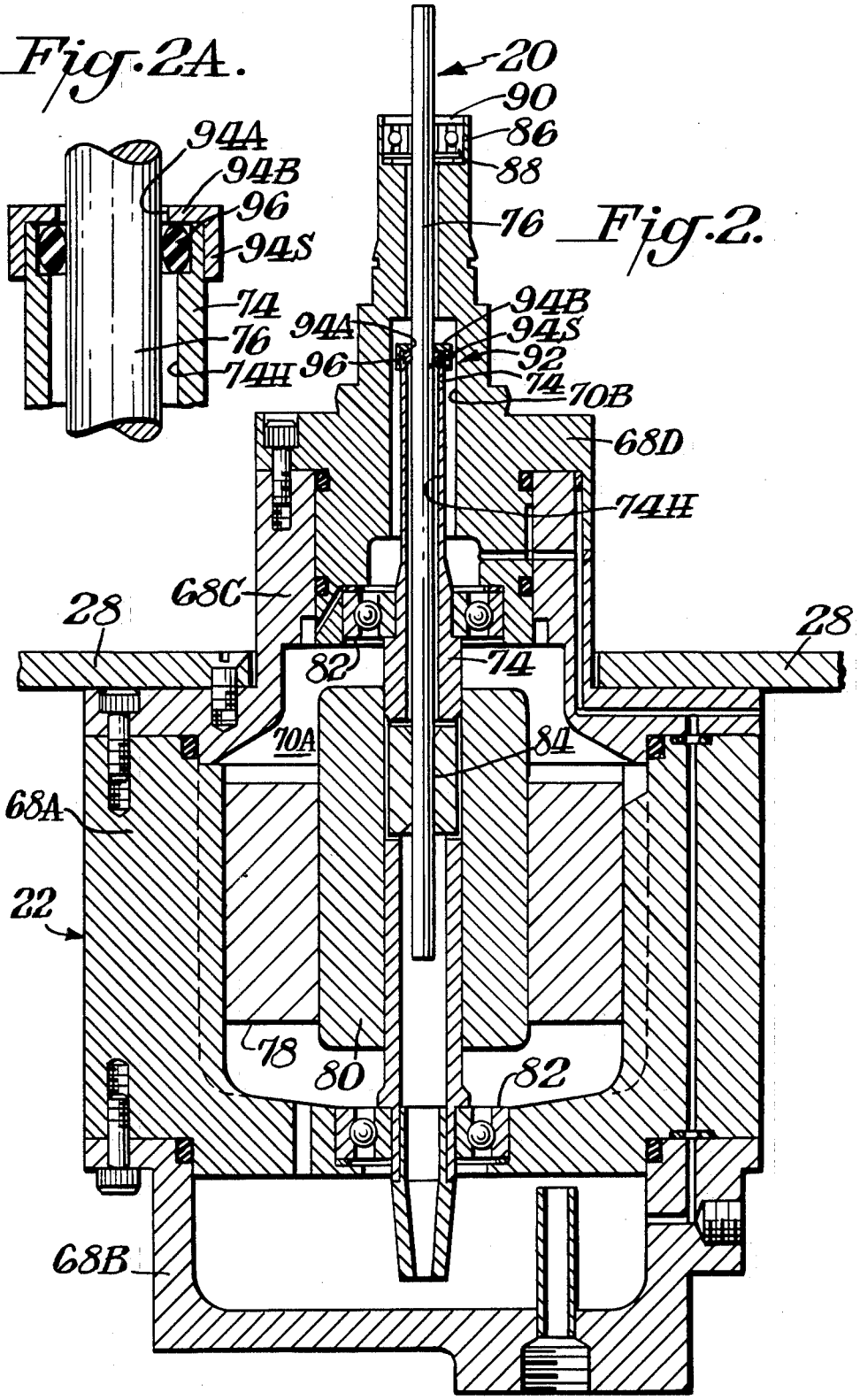

With reference to FIG. 2 shown is a detailed view of a drive cartridge 22. The drive cartridge 22 includes a plurality of housing elements which cooperate to define a volume 70 on the interior of the cartridge 22. In FIG. 2 the cartridge housing 68 is defined by a substantially cylindrical first portion 68A closed at its lower end by a cup shaped portion 68B. A crown portion 68C of narrower diameter is mounted atop the cylindrical portion 68A. The crown 68C receives a cap 68D having a reduced diameter bore therethrough. Accordingly, the combination of the above-described structural elements 68A through 68D results in the definition of an enlarged chamber 70A adjacent the lower interior portion of the drive cartridge and a narrower bore 70B within the upper portion of the cartridge.

Within the enlarged lower portion of the drive cartridge is contained a source of motive energy for the rotor. The source may be either a oil turbine drive or, alternatively, a variable frequency AC drive. Either alternative, among any others, lies within the contemplation of the present invention. Suffice it to say that whatever motive source is utilized it is operatively connected to an elongated, hollow lower shaft element called the bearing shaft 74, which, when coupled in a manner to be described to an axially contiguous elongated upper flexible shaft element 76 defines the drive shaft assembly 20 interconnecting the source to the rotor.

In accordance with the embodiment of the invention shown in FIG. 2, a variable frequency AC drive arrangement is used as the motive source. Therefore a stator winding 78 is disposed on the interior of the lower cylindrical portions 68A, 68B of the drive cartridge and a corresponding rotary winding 80 is wrapped about a predetermined portion of the bearing shaft 74. Alternatively, as noted above, the bearing shaft 74 may be provided with an oil turbine having angulated vanes arranged thereon onto which are directed jets of high presssure drive oil introduced through suitable nozzles. Suitable bearings 82 are provided to rotationally support the bearing shaft element 74 for rotational movement with respect to the interior portions 68A, 68C of the cartridge.

The flexible shaft element 76 of the drive shaft extends inwardly for a predetermined portion of its length into the hollow central region 74H of the bearing shaft element 74 portion whereat it is secured as by a press fit 84 or other suitable attachment to the bearing shaft element. The flexible shaft element 76 projects upwardly out of the cap portion 68D of the cartridge and into the bowl 16 whereon the drive adapter and the rotor may be mounted. To guard against gross vibration of the flexible shaft element 76 of the drive shaft assembly the upper portion 68D of the cartridge housing is provided with a counterbore 86 which receives suitable bearing element 88 which is retained in that counterbore by a washer and retaining ring 90.

In accordance with the present invention a damper arrangement 92 is mounted to the drive shaft assembly for rotation therewith. In the embodiment of the invention shown in FIGS. 2 and 2A the damper arrangement 92 includes an inverted cup shaped member 94 having a base portion 94B a central aperture 94A. A downwardly depending skirt 94S which overlies a portion of the upper end of the bearing shaft element 74 of the drive shaft assembly. The damper arrangement 92 includes a resilient member 96 such as an $\sigma$-ring which is confined between the exterior of the flexible shaft element 76 and the interior of the bearing shaft element 74. The resilient member 96 is adapted to accommodate vibrations imparted to the flexible shaft element and damp the same. Although the resilient member 96 is shown as mounted to the flexible shaft element 76 at a portion therealong adjacent to the upper end of the bearing shaft portion 74 it is to be understood that the resilient member 96 may be mounted at any point along that portion of the flexible shaft element 76 that is received within, concentrically surrounded by and telescopically overlapped by the bearing shaft element 74.

Figure 3:
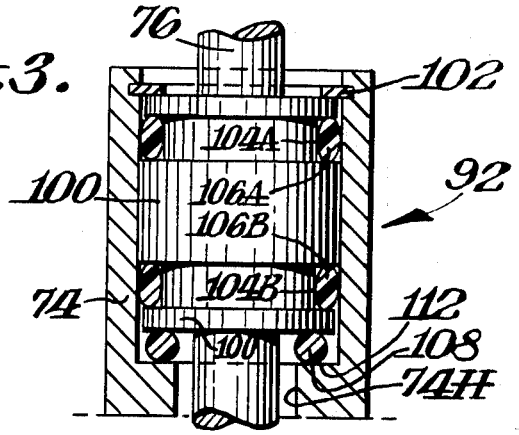
FIG. 3 is a section view of an alternate embodiment of the damper arrangement in accordance with the present invention.

In the alternate embodiment of the invention shown in FIG. 3 the damper arrangement 92 takes the form of an elongated cylindrical sleeve 100 that is slip fit on the flexible shaft element and positioned between the flexible shaft element 76 and the bearing shaft element 74. A lock ring 102 maintains the damper arrangement 92 in this location although, as noted above, the damper arrangement 92 may be provided at any predetermined location along the flexible shaft element 76 that is received within the bearing shaft element 74. In this embodiment of the invention the sleeve 100 is provided on the exterior surface thereof with an array of axially spaced grooves 104A and 104B each of which receives a resilient member such as $\sigma$-ring 106A and 106B. An $\sigma$-ring 108 is confined between a collar 110 on the flexible shaft element 76 and an internal shoulder 112 of the bearing shaft element 74.

In operation rotation of the bearing shaft element 74 of the drive shaft assembly is imparted to the flexible shaft element 76 of the drive shaft assembly and thereby to the drive adaptor 18 and the rotor 12. The damper arrangement 92 is mounted for rotation with the flexible shaft element 76 is not disposed along a frictional interface with the flexible shaft element as in the prior art. Accordingly the power requirements imposed on the prior drive system in order to overcome the frictional loading along such an interface is eliminated. Moreover the often cumbersome and inconvenient requirement of providing a source of lubricating fluid to such an interface is eliminated. Although the frictional loading present in the prior art is eliminated the provision of the resilient damper member is sufficient to provide the damping function and to damp vibrations imparted to the flexible shaft element by the rotor.

Those skilled in the art, having benefit of the teachings of the present invention as hereinabove set forth may effect numerous modifications thereto. These modifications, however, to be construed as falling within the scope of the present invention as defined in the appended claims.

What is claimed is:

1. A centrifuge comprising:

a rotor rotatable within a chamber about an axis of rotation;

a drive cartridge connected beneath the chamber;

a source of motive energy disposed within the cartridge;

a drive shaft assembly comprising a flexible shaft element connected to an axially contiguous hollow bearing shaft element, the flexible shaft element having one end thereof projecting into the chamber to receive the rotor thereon and a second end thereof projecting a predetermined distance into one end of the hollow bearing shaft element, the other end of the bearing shaft element being connected in a driven relationship with a source of motive energy; and a damper arrangement mounted between the flexible shaft element and the bearing shaft element at a point along the flexible shaft element received within the bearing shaft element, the damper arrangement including a resilient member disposed between the exterior surface of the flexible shaft element and the interior surface of the bearing shaft element, the damper arrangement rotating with the drive shaft assembly and being operative to damp vibration imposed on the flexible shaft element by the rotor.

2. The centrifuge of claim 1 wherein the resilient member is mounted to the flexible shaft element at a point therealong adjacent the open end of the hollow bearing shaft element.

3. The rotor of claim 2 wherein the damper arrangement comprises substantially inverted cup shaped member having a central opening in the base portion thereof, the resilient member being mounted to the flexible shaft element at a point therealong substantially adjacent one end of the bearing shaft element such that the side wall of the cup shaped member overlies a portion of the exterior of the bearing shaft element, the resilient member being disposed intermediate the exterior surface of the flexible shaft element and the interior surface of that portion of the bearing shaft element overlaid by the sidewall of the cup shaped member.

4. The rotor of claim 2 wherein the damper arrangement comprises a substantially cylindrical sleeve having a central bore therethrough, the sleeve being mounted on the flexible shaft element at a point thereon substantially adjacent to one end of the bearing shaft element, the sleeve having a circumferential groove disposed on the exterior surface thereof, the resilient member being confined within the groove and disposed between the cylindrical sleeve and the interior surface of the bearing shaft element.

5. The rotor of claim 1 wherein the damper arrangement comprises substantially inverted cup shaped member having a central opening in the base portion thereof, the resilient member being mounted to the flexible shaft element at a point therealong substantially adjacent one end of the bearing shaft element such that the side wall of the cup shaped member overlies a portion of the exterior of the bearing shaft element, the resilient member being disposed intermediate the exterior surface of the flexible shaft element and the interior surface of that portion of the bearing shaft element overlaid by the sidewall of the cup shaped member.

6. The rotor of claim 1 wherein the damper arrangement comprises a substantially cylindrical sleeve having a central bore therethrough, the sleeve being mounted to the flexible shaft element at a point thereon substantially adjacent to one end of the bearing shaft element, the sleeve having a circumferential groove disposed on the exterior surface thereof, the resilient member being confined within the groove and disposed between the cylindrical sleeve and the interior surface of the bearing shaft element.

* * * * *